United States Patent [19]

Stevenson

[11] Patent Number: 4,624,684

[45] Date of Patent: Nov. 25, 1986

[54] PROCESS FOR FEEDING AND GASIFYING SOLID CARBONACEOUS FUEL

[75] Inventor: John S. Stevenson, Gardena, Calif.

[73] Assignee: Texaco Inc., White Plains, N.Y.

[21] Appl. No.: 772,098

[22] Filed: Sep. 3, 1985

[51] Int. Cl.[4] ..... C10J 3/46

[52] U.S. Cl. ..... 48/197 R; 48/202; 48/206; 48/209; 48/DIG. 7; 252/373

[58] Field of Search ..... 48/197 R, 202, 206, 48/DIG. 7, 197 A, 203, 209; 406/197; 252/373

[56] References Cited

U.S. PATENT DOCUMENTS

| | | | |
|---|---|---|---|
| 3,871,839 | 3/1975 | Moody | 48/DIG. 7 |
| 4,153,427 | 5/1979 | Bissett et al. | 48/DIG. 7 |
| 4,166,802 | 9/1979 | Slate et al. | 48/DIG. 7 |
| 4,341,530 | 7/1982 | Loth et al. | 48/DIG. 7 |

*Primary Examiner*—Peter Kratz

*Attorney, Agent, or Firm*—Robert A. Kulason; James J. O'Loughlin; Albert Brent

[57] ABSTRACT

A partial oxidation process for the production of a stream of mixed gases comprising $H_2$ and CO. An aqueous particulate solid carbonaceous fuel slurry feedstream is preheated by indirect heat exchange with a process-derived stream of skimmed gases substantially comprising $H_2O$. The aqueous carrier of the slurry is vaporized by introducing superheated steam directly into the slurry pipeline. A suspension of particulate solid carbonaceous fuel entrained in a gaseous mixture substantially comprising steam e.g. about 90 to 99.9 wt. % $H_2O$ and about 0.1 to 10 wt. % of a $CO_2$-containing gas mixture is produced. The suspension of solid fuel in the gaseous mixture is then separated in a skimming operation into an overhead gas stream substantially comprising steam, as previously described, and a bottom stream comprising particulate solid carbonaceous fuel with the remainder of said gaseous mixture. The bottom stream from the skimming operation is introduced into the reaction zone of a partial oxidation gas generator in admixture with a free-oxygen containing gas and with or without a temperature moderator where a gaseous stream comprising $H_2+CO$ is produced. In one embodiment, the temperature of the suspension of solid carbonaceous fuel feed stream entering the partial oxidation reaction zone by way of a burner is monitored. An increase in temperature would flag the back-flow of synthesis gas or oxygen into the burner. When this happens, the feedlines to the burner and the overhead gas stream from the cyclone separator may be automatically shut down to prevent thermal damage to the system.

24 Claims, 1 Drawing Figure

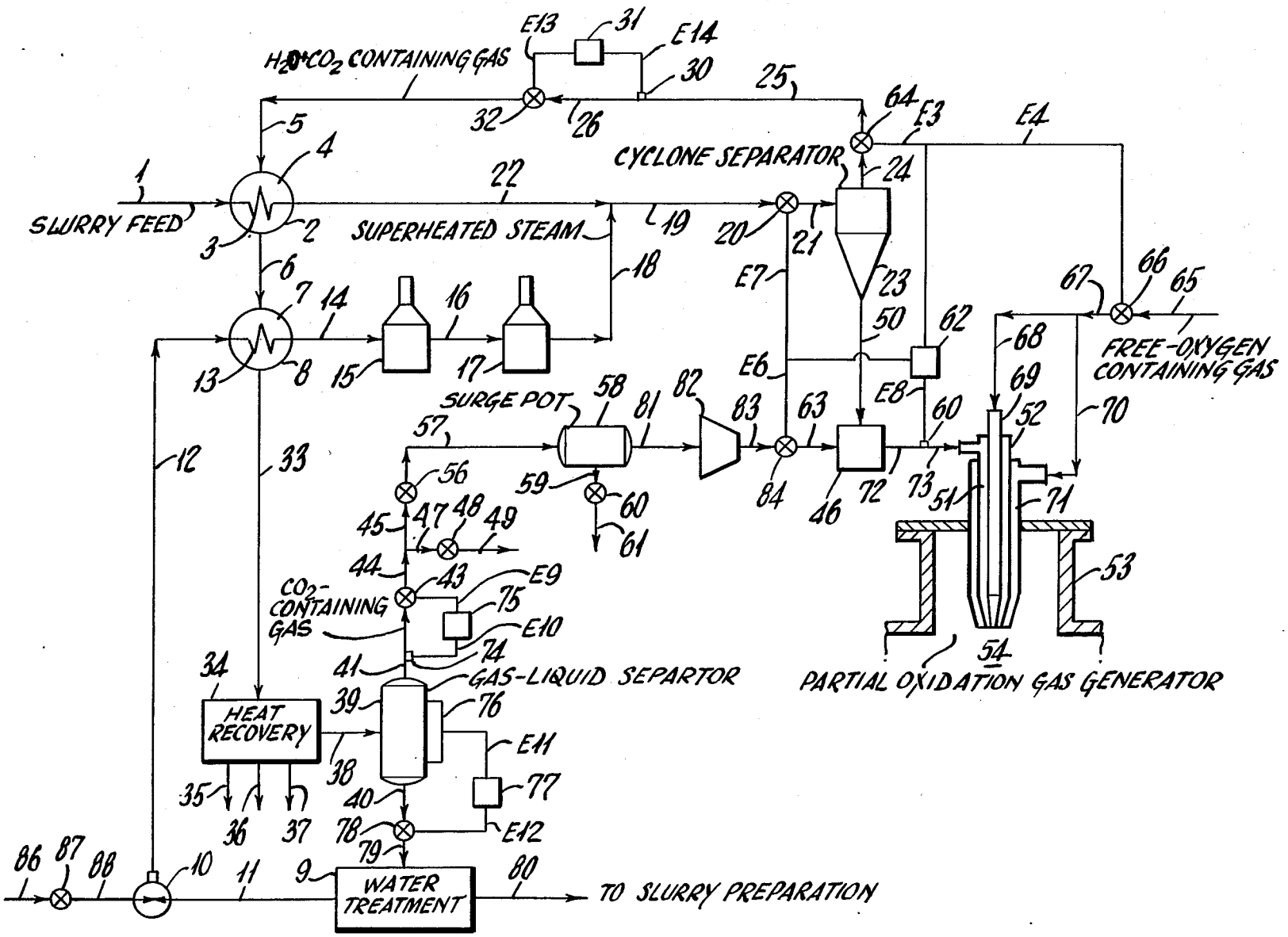
FREE-OXYGEN CONTAINING GAS
PARTIAL OXIDATION GAS GENERATOR
CYCLONE SEPARATOR
SUPERHEATED STEAM
SURGE POT
GAS-LIQUID SEPARTOR
TO SLURRY PREPARATION
WATER TREATMENT
HEAT RECOVERY
$CO_2$-CONTAINING GAS
$H_2O$-$CO_2$ CONTAINING GAS
SLURRY FEED

PROCESS FOR FEEDING AND GASIFYING SOLID CARBONACEOUS FUEL

BACKGROUND OF THE INVENTION

This invention relates to a process for the production of gaseous streams comprising $H_2$ and CO e.g. synthesis gas, reducing gas, and fuel gas by the partial oxidation of solid carbonaceous fuels. More specifically, it pertains to a process for feeding particulate solid carbonaceous fuel to a partial oxidation gas generator operating at high pressure.

The partial oxidation of solid carbonaceous fuels, such as coal or petroleum coke represents a well-known, highly economical method for the production of large quantities of gaseous mixtures comprising $H_2$, CO, $CO_2$, $H_2O$, $CH_4$, $N_2$, COS, and $H_2S$. The solid fuel may be introduced into the free-flow reaction chamber as a dispersion or suspension of pulverized or particulate solid carbonaceous fuel in a gaseous or liquid carrier.

In coassigned U.S. Pat. Nos. 2,595,234- Eastman; 2,946,670- Whaley; 2,987,387- Carkeek et al; and 3,544,291 -Schlinger et al, the solid fuel in particle form is mixed with water to form a slurry or suspension of the solid particles. The suspension is passed through a tubular heating zone, for example, an externally heated helical coil, wherein it is heated and substantially all of the water is converted into steam. A dispersion of solid fuel particles in steam is formed in the heating step and is then introduced into the reaction zone. One disadvantage of the prior art process is the difficulty in maintaining the slurry heaters which are subject to scale formation on the inner surface of the heater tubes and erosion from the solid particles. Further, should excess $H_2O$ be introduced into the reaction zone, the efficiency of the process is reduced. The process of the present invention avoids these problems by obviating the necessity for the use boilers or heaters for the coal-water slurry feed to the gas generator. Further, there is better control of the amount of $H_2O$ that enters the reaction zone of the partial oxidation gas generator.

Substantially all or a portion of the steam from the aforesaid dispersion may be removed by means of a vortex chamber or cyclone separation as provided in coassigned Carkeek et al U.S. Pat. Nos. 2,829,957; 2,864,156; and 2,987,387. This step is also present in U.S. Pat. No. 3,871,839- Moody, and U.S. Pat. No. 4,153,427- Bissett et al. While the previous steam skimming feed systems offer some potential advantage in enhancing gasification efficiency, a major problem with them is encountered in designing the necessary slurry vaporizers. This is due to lack of knowledge of the heat transfer coefficients and processes associated with slurry vaporization, difficulties with control aspects, coking, plugging, and fouling problems. These problems have been avoided by the subject process. It was unexpectedly found in the subject process that by direct injection of superheated steam into the slurry lines to vaporize the slurry, the solid carbonaceous fuel may undergo thermal beneficiation producing a $CO_2$-containing by-product gas stream. Using direct injection of superheated steam to vaporize the slurry has a number of other advantages over the use of prior art skimming systems, steam exchangers of fire heaters. Some of these other advantages follow:

1. By using direct injection into the pipeline carrying the aqueous slurry of particulate solid carbonaceous fuel, it becomes much simpler to control the vaporization process since known quantities of steam are added at particular locations.
2. Problems with fouling or char formation are avoided.
3. Designs are simplified over those of heat exchangers and entrained bed dryers since it becomes much simpler to predict vapor and bulk velocities in the system.

SUMMARY

This invention relates to a partial oxidation process for solid carbonaceous fuel in which a stream of mixed gases comprising $H_2$ and CO is produced. In the process an aqueous slurry of particulate solid carbonaceous fuel is heated to a temperature in the range of 200° F. to 650° F. in a first indirect heat exchange zone by noncontact heat exchange with a process derived stream of skimmed gases substantially comprising $H_2O$. The preheated aqueous slurry is then mixed in the feedline to a cyclone separator with a stream of superheated steam which is preferably produced in the process. The aqueous carrier for the slurry is vaporized by introducing the superheated stream directly into the slurry pipeline to produce a suspension of particulate solid carbonaceous fuel entrained in a gaseous mixture, substantially comprising steam, e.g. 90 to 99.9 wt. % $H_2O$, and the remainder (about 0.1 to 10 wt. %) comprises a $CO_2$-containing gas mixture which is produced when the solid carbonaceous fuel is thermally upgraded. More $CO_2$-containing gas mixture is produced with low rank solid carbonaceous fuels and at higher temperatures in the slurry pipeline, than that which may be produced with high rank solid carbonaceous fuels and at lower temperatures. The suspension of solid fuel in the gaseous mixture is then separated in a skimming operation, including a cyclone separator, to produce an overhead skimmed gaseous mixture, substantially comprising steam, and a bottom stream comprising particulate solid carbonaceous fuel with the remainder of the gaseous mixture. The $H_2O$ in this gaseous mixture is recovered and may be reused in the process. The bottom stream from the skimming operation is introduced into the reaction zone of a partial oxidation gas generator for the production of synthesis gas. In one embodiment, the temperature of the suspension of solid carbonaceous fuel feed stream entering the partial oxidation reaction zone by way of a burner is monitored. An increase in temperature would indicate a back-flow of synthesis gas or oxygen into the burner. When this happens, the feedlines to the burner and the overhead gas stream from the cyclone separator may be automatically shut down to prevent thermal damage to the system.

BRIEF DESCRIPTION OF THE DRAWING

In order to illustrate the invention in greater detail, reference is made to a preferred embodiment shown in the drawing.

DESCRIPTION OF THE INVENTION

A more complete understanding of the invention may be had by reference to the accompanying schematic drawing. Although the drawing illustrates a preferred embodiment of the invention, it is not intended to limit the subject invention to the particular apparatus or materials described. The drawing depicts a process for introducing superheated steam into an aqueous slurry of solid carbonaceous fuel and feeding the particulate solid carbonaceous fuel entrained in a gaseous mixture into a partial oxidation gas generator operating at a temperature in the range of about 1800° to 3000° F. and pressure in the range of about 5 to 300 atmospheres, such as about 20 to 150 atmospheres, say 30 to 80 atmospheres. A stream of mixed gases is thereby produced comprising $H_2+CO$ and at least one gas selected from the group consisting of $CO_2$, $H_2O$, $CH_4$, $N_2$, COS, $H_2S$, and mixtures thereof. In addition, a separate stream of $CO_2$-containing gas may be produced.

The feed to the system comprises any suitable combustible particulate solid carbonaceous fuel. This invention proposes a technique for vaporizing the water in aqueous slurries of solid carbonaceous fuels. It has significant advantages over the use of indirect heat exchange techniques such as accomplished by the use of high pressure steam exchangers or direct fired slurry heaters.

In the subject process, an aqueous slurry of particulate solid carbonaceous fuel, as prepared in a conventional slurry preparation facility (not shown), is preheated by being passed through line 1 and heat exchanger 2 in noncontact indirect heat exchange with a skimmed gas mixture that is produced subsequently in the process and which substantially comprises steam. The skimmed gas mixture substantially comprises steam e.g. about 90 to 99.9 wt. %, such as about 95 to 99 wt. % of steam, and the remainder (about 0.1 to 10 wt. %), comprises a $CO_2$-containing gas mixture that may be produced when superheated steam contacts the solid carbonaceous fuel in line 19. The actual amount of $CO_2$-containing gas in the skimmed gas mixture is a function of the rank of the solid carbonaceous fuel feed and the temperature of the slurry and superheated steam mixture in line 19. Low rank fuels and higher mixing temperatures produce more $CO_2$-containing gas than high rank fuels and lower temperatures. The mole ratio $(H_2O+CO_2)/C$ of the feed entering the reaction zone is in the range of about 0.1 to 3.0, such as about 0.5 to 2.0. Thus, an aqueous slurry feed is passed through tubing 3 in heat exchanger 2, and the skimmed gas mixture is passed through heat exchanger 2 on the shell side 4. Of course the material flow may be interchanged. The aqueous solid fuel slurry has a solids content in the range of about 40 to 70 wt. %, such as 50 to 65 wt. %.

In heat exchanger 2, the slurry feedstream is preheated to a temperature in the range of about 200° to 650° F., such as about 350° to 600° F. and below the water vaporization temperature. The temperature of the skimmed gas mixture entering heat exchanger 2 through line 5 is in the range of about 400° to 800° F., such as about 500° F. to 750° F. The pressure is in the range of about 5 to 300 atmospheres, such as about 20 to 150 atmospheres. During the heat exchange step, the skimmed gas mixture may or may not be reduced to or below the dew point. Accordingly, at this point the partially cooled skimmed gas mixture may or may not contain condensed water. That is, none, all, or a portion of the $H_2O$ in the skimmed gas stream in line 5 may be condensed out in heat exchanger 2. Any remaining $H_2O$ in the partially cooled skimmed gas stream in line 6 is condensed out in heat exchanger 8 and/or heat recovery zone 34. In the preferred embodiment, additional heat is recovered from the skimmed gas mixture in line 6 by being passed, for example, through the shell side 7 of heat exchanger 8. Preferably the coolant is a portion of the recycled water from water treatment facility 9. The purified water is pumped from line 11 by means of pump 10 through line 12, and tubing 13 in heat exchanger 8. Water, preheated below the saturation point, leaves heat exchanger 8 through line 14 and may be vaporized and superheated, for example, in an oil fired heater 15. If the steam in line 16 is not already superheated, it may be superheated in an oil fired heater 17 to a temperature in the range of about 650° to 1500° F., such as about 900° to 1200° F., say about 1100° F. Alternatively, the preheated water in line 14 may be converted into superheated steam by being passed in indirect heat exchange with the hot raw effluent product gas from the gas generator 54. The superheated steam is then passed through line 18 and mixed directly in feed line 19, valve 20, and line 21 with the stream of preheated aqueous slurry of solid carbonaceous fuel from lines 1 and 22. By this means, the water in the slurry is vaporized and the steam mixes with any $CO_2$-containing gas that may be produced by the action of the superheated steam on the solid carbonaceous fuel.

The gaseous suspension of solid carbonaceous fuel in line 21 is at a temperature in the range of about 400° to 800° F., such as at least 500° to 750° F.; and it is introduced into a conventional gas-solids separator, such as cyclone separator 23. Separation of gaseous materials and solid particulate matter is discussed on pages 20–74 to 20–97 in the Chemical Engineers' Handbook - Perry and Chilton, Fifth Edition, McGraw Hill, N.Y., which is incorporated herein by reference. Suitable equipment for separating the gaseous suspension of solid carbonaceous fuel includes conventional dry-type separators including centrifugal, impingement, mechanical, and combinations thereof. Alternatively, the cyclone gas-solids separator may be combined with a conventional partial oxidation burner, such as described in coassigned U.S. Pat. No. 2,829,957 which is incorporated herein be reference.

The skimmed gaseous overhead from cyclone separator 23 in line 24 comprises from about 10 to 99 volume %, such as about 88 vol. % of the entering gaseous materials. The portion of entering gaseous materials taken off through the overhead steam from the cyclone separator may be controlled by means such as a flow control device or pressure control device consisting of a conventional sensor 30 in line 25, controller 31 and valve 32 in line 26 which are connected by means of signals E13 and E14. Alternatively, suitable control may be achieved by means of a differential pressure control which controls the overhead flow based on the differential pressure between the overhead stream 24 from the cyclone separator and bottoms stream 50 from the cyclone separator. The remainder of the entering gaseous materials leaves in admixture with the particulate solid carbonaceous fuel by way of line 50 at the bottom of cyclone separator 23. This stream may enter directly into one annular passage 51 of a conventional partial oxidation burner 52. The burner is vertically mounted in the upper central inlet port 53 of a conventional free-flow vertical down flowing partial oxidation gas generator 54. Alternatively, the feedstream of solid carbonaceous fuel in admixture with the portion of the gaseous materials in line 50 may be introduced into a venturi mixture, mixing tee or other suitable mixing device 46. There it is mixed with a stream of the process derived $CO_2$-containing gas, such as from line 63, prior to being passed through lines 72 and 73 and into annular passage 51 of burner 52. Free-oxygen containing gas, optionally in admixture with temperature moderator, is preferably introduced into annular type burner 52 by way of line 65, valve 66, lines 67 and 68 into central passage 69. Simultaneously, a second stream of free-oxygen containing gas, optionally in admixture with temperature moderator is passed through line 70 into outer annular passage 71. Alternatively, cyclone separator 23 and burner 52 may be combined into a cyclone burner.

The gaseous stream comprising $H_2O$ + $CO_2$-containing gas from line 6 is preferably cooled to the dew point or below in indirect heat exchanger 8 and leaves through line 33. Optionally, this wet stream of gases may be introduced into a heat recovery zone 34 to produce one or more of the following streams; intermediate and low pressure steam, and preheated boiler feed water in lines 35, 36 and 37 respectively. Alternatively, the remaining heat energy in the wet stream of gases may be recovered to produce other levels of steam such as medium pressure steam, or may be used in some other indirect heat exchange step to provide overall process economy. The stream of water and $CO_2$-containing gas in line 38 is introduced into gas-liquid separator 39. Water is removed continuously through line 40, valve 78, line 79 and sent to water treatment facility 9 where it is purified by at least one or more or the following steps: deaeration, deionization and filtration. A stream of purified water and a separate stream of residual waste water are produced. The purified water leaves through line 11 and may be converted into superheated steam in the manner previously described. The residual waste water in line 80 may be recycled to a conventional aqueous-solid carbonaceous fuel slurry preparation facility (not shown) for preparation of the slurry feed in line 1. Fresh make-up purified water may be introduced into the system through line 86, valve 87, line 88, and pump 10. The water level in the gas -liquid separator 39 is controlled by means of a level control device consisting of a conventional level sensor 76, controller 77 and valve 78 in line 40 which are connected by means of signals E11 and E12. The pressures under which heat is recovered from the cyclone separator overhead stream of hot gaseous $H_2O$ and $CO_2$-containing gas in heat exchangers 2 and 8 and in heat recovery zone 34 may be controlled using a suitable pressure control device located on the overhead line 41 from the gas-liquid separator 39. This may consist of a conventional pressure sensor 74, in line 41, controller 75 and valve 76 which are connected by means of signals E9 and E10.

The overhead stream of $CO_2$-containing gas from gas-liquid separator 39 in line 41 and that produced in line 19 substantially comprises in volume %: $CO_2$ about 5 to 95; CO about 0.1 to 10; $CH_4$ about 0.1 to 15; $NH_4$ about 0.1 to 5; and the remainder $H_2O$. In one embodiment, this gas stream may be passed through lines 41–42, valve 43, and line 44–45, valve 56, line 57 and into surge pot 58 where adequate surge capacity is supplied to meet the process requirements. Condensate carried with the gas into surge pot 58 is removed through line 59, valve 60, and line 61. The $CO_2$-containing gas may be then passed through line 81 to compressor 82 where it is compressed to a pressure sufficient to introduce the $CO_2$-containing gas through line 83, valve 84, line 63 into mixing device 46. In another embodiment, the stream of $CO_2$-containing gas from gas-liquid separator 39 may be introduced into the partial oxidation burner as a separate stream or in admixture with another temperature moderator e.g. steam or recycle synthesis gas. Alternatively, a portion, e.g. about 10–100 vol. %, of the $CO_2$-containing gas in line 44 may be removed through line 47, valve 48, and line 49 and vented to the atmosphere with or without prior treatment.

In one embodiment, the temperature of the feedstream of solid carbonaceous material entrained in gaseous material in line 72 is monitored by a conventional temperature sensor 60. Signal E8 corresponding to the temperature of the feedstream in line 72 is sent to flow rate regulating means 62. When signal E8 exceeds the set point in controller 62, then signals E3 and E7 are provided to close normally open control valve 20 in line 19 and control valve 64 in overhead line 24. Further, signal E4 is provided to close normally open control valve 66 in oxidant line 65, and signal E6 is provided to close normally open valve 84 in line 83. By this means, the flow in overhead line from cyclone 23 and the feedstreams to the burner may be cut off when any hot gaseous stream such as free-oxygen containing gas or synthesis gas from the gas generator unexpectedly backs up through the burner and into the overhead lines. Serious safety problems are thereby avoided.

The term solid carbonaceous fuels, as used herein to describe suitable solid carbonaceous feedstocks, is intended to include a high rank fuel selected from the group consisting of anthracite coal, bituminous coal, coke from coal, char from coal, coal liquefaction residues, particulate carbon, petroleum coke, solids derived from oil shale, tar sands and pitch; and/or low rank fuel selected from the group consisting of sub-bituminous coal, lignite, peat, concentrated sewer sludge, bits of garbage, wood, and mixtures thereof.

Any suitable grinding system may be used to convert the solid carbonaceous fuels or mixtures thereof to the proper size. The solid carbonaceous fuels are preferably ground to a particle size so that 100% of the material passes through an ASTM E 11–70 Sieve Designation Standard 1.4 mm (Alternative No. 14).

Simultaneously with the fuel stream(s), a free-oxygen containing gas stream is supplied to the partial oxidation gas generator by way of a free passage(s) in the burner. The free-oxygen containing gas may be passed through the central and/or annular conduits at a temperature in the range of about ambient to 1500° F., and preferably in the range of about ambient to 300° F., and a pressure in the range of above about 5 to 300 atmospheres, such as 20 to 150 atmospheres, say 30 to 80 atmospheres. The atoms of free-oxygen plus atoms of organically combined oxygen in the solid carbonaceous fuel per atom of carbon in the solid carbonaceous fuel (O/C atomic ratio) may be in the range of 0.5 to 1.95.

The term free-oxygen containing gas, as used herein is intended to include air, oxygen-enriched air, i.e., greater than 21 mole % oxygen, and substantially pure oxygen, i.e., greater than 95 mole % oxygen, (the remainder comprising $N_2$ and rare gases).

The free-oxygen containing gas may be supplied with or without mixture with a temperature moderating gas. The term temperature moderator or temperature moderating gas as employed herein is intended to include by definition a member of the group consisting of steam, water, $CO_2$-containing gas, nitrogen, a recycle portion of the cooled and cleaned effluent gas stream from the gas generator, e.g., synthesis gas, and mixtures thereof. When supplemental steam is employed as a temperature moderator, all of the steam may be passed through one passageway. Alternatively, about 0 to 25 volume percent of the steam may be mixed with the stream of free-oxygen containing gas and passed through one passageway, and the remainder of the steam may be passed through another passageway.

EXAMPLE

The following Example illustrates a preferred embodiment of this invention. The Example should not be construed as limiting the scope of the invention. The process is continuous and the flow rates are specified on an hourly basis for all streams of materials.

A 50 wt. % solid aqueous slurry of a low rank coal e.g. lignite at a temperature of about 140° F. and a pressure of about 825 psig is preheated to a temperature of 500° F. by indirect heat exchange with a recycle mixed stream comprising 1691 lbs. of steam and 26 lbs. of $CO_2$-containing gas at a temperature of 593° F. and a pressure of 700 psig from a conventional gas-solids cyclone separator. The hot slurry at a temperature of 500° F. and a pressure of 800 psig is then mixed in the line with 1426 lbs. of superheated steam having a temperature of 1090° F. and a pressure of 800 psig. Whereupon the water in the aqueous slurry is vaporized and superheated, so that the mixture has a final temperature of about 600° F. At this temperature some coal volatiles are produced substantially comprising $CO_2$ e.g. greater than 90 vol. % $CO_2$. The coal volatiles are in the amount of about 6 wt. % of the coal on a dry basis. The stream produced substantially comprises dry coal, dry steam and $CO_2$-containing gas. This stream is fed to a cyclone separator or cyclone burner where at a temperature of about 600° F., and a pressure of about 750 psig a bottom stream of dry coal and about 12.2 vol. % of the mixed stream of $H_2O + CO_2$-containing gas is separated from the feed stream. This bottom stream comprising about 470 lbs. of coal, 235 lbs. of steam, and 4 lbs. of $CO_2$-containing gas at a temperature of 595° F. and a pressure of about 675 psig is then mixed with a gaseous free-oxygen containing gas, with or without a temperature moderator, in a burner and fed into a conventional free-flow refractory lines vertical down-flowing synthesis gas generator. The partial-oxidation reaction takes place in the gas generator at a temperature of about 2400° F. and a pressure of 600 psig. The $(H_2O + CO_2)/C$ mole ratio entering the reaction zone is about 0.5. The hot raw effluent stream of synthesis gas leaving the gas generator comprises $H_2$, CO, $CO_2$, $H_2O$ and at least one gas from the group consisting of $CH_4$, $N_2$, $H_2S$ and COS. The remaining portion of the dry stream and $CO_2$-containing gas (skimmed portion) is taken off through the top of the cyclone separator or cyclone burner and is then advantageously recycled. A portion of the sensible heat is first recovered from the skimmed steam and $CO_2$-containing gas stream to provide the necessary preheat for the feed slurry. Additional sensible heat is then recovered by preheating the water feed to the steam vaporizer and superheater to a temperature of 470° F. The remaining heat in the skimmed steam $+ CO_2$-containing gas stream may be then recovered in a heat recovery unit to produce about 681 lbs. of intermediate pressure steam (388° F.), 306 lbs. of low pressure steam (298° F.) and 2147 lbs. of preheated boiler feed water. Following heat recovery, the water and volatiles are separated in a knockout pot operating at a temperature of about 120° F. and a pressure of about 600 psig. The water is sent for water treatment, which may consist of at least one or more of the following steps: a deaeration step, a demineralizing step and a filtration step. 1426 lbs. of said purified water at a temperature of about 212° F. and a pressure of about 900 psig is superheated to produce the required stream of superheated steam for the skimming operation. About 240 lbs. of residue waste water from water treatment facility 9 are mixed with 135 lbs. of fresh water and 625 lbs. of fresh pulverized low rank coal having a moisture content of 20 wt. % to produce the aqueous slurry feedstock to the process. The volatiles overhead product from the knockout pot comprising 26 lbs. of a $CO_2$-containing gas can be fed with the solid carbonaceous fuel to the burner, or discharged to the atmosphere, with or without prior treatment.

In the proposed system, where superheated steam injection is used, the higher temperatures provide not only a dry coal feed, but may also enhance the coal properities through benefication. At these temperatures the volatiles lost by the coal are predominantly $CO_2$. Also, the superheated steam which is injected represents a component already in the aqueous coal slurry feed. Fired heaters may be used to vaporize and superheat the injection steam. The recycle stream is cooled to condense and separate water from any volatiles which are produced. After treatment, the water may be advantageously used as boiler feed water to produce superheated steam for use in the skimming operation, or alternatively in preparation of the aqueous-coal slurry feed.

Various modifications of the invention as herein before set forth may be made without departing from the spirit and scope thereof, and therefore, only such limitations should be made as are indicated in the appended claims.

I claim:

1. A process for the production of a stream of mixed gases comprising $H_2$ and CO comprising:

(1) heating an aqueous slurry of particulate solid carbonaceous fuel to a temperature in the range of about 200 to 650° F. in a first indirect heat exchange zone by noncontact heat exchange with a stream of skimmed gases from (3) to produce a preheated aqueous slurry stream and a separate partially cooled stream of skimmed gases;

(2) mixing the prehated aqueous slurry from (1) in a mixing zone with a separate stream of superheated steam, thereby vaporizing the water in the slurry and producing a suspension of particulate solid carbonaceous fuel entrained in a gaseous mixture comprising steam and carbon dioxide, at a temperature of at least 400° F.;

(3) separating from about 10 to 99 wt. % of the gaseous mixture from said suspension in (2) in a cyclone separating zone to produce an overhead stream of skimmed gases comprising steam and carbon dioxide, and a bottom stream comprising a mixture of particulate solid carbonaceous fuel and the remainder of said gaseous mixture;

(4) cooling said partially cooled stream of skimmed gases from (1) and condensing $H_2O$;

(5) purifying water that was condensed from the stream of skimmed gases to produce a stream of purified water and a separate stream of residual waste water;

(6) introducing said bottom stream from (3) by way of a burner into the reaction zone of a free-flow partial oxidation gas generator where in admixture with a free-oxygen containing gas and with or without additional temperature moderator, reaction takes place for the production of a hot raw product gas stream comprising $H_2$ and CO;

(7) mixing at least a portion of the residual waste water from (5) with particulate solid carbonaceous fuel to produce at least a portion of said aqueous slurry in (1); and (8) converting said purified water from (5) into at least a portion of said superheated steam used in (2).

2. The process of claim 1 where in (2) said particulate solid carbonaceous fuel is entrained in a gaseous mixture substantially comprising 90 to 99.9 wt. % steam, and the remainder comprises a $CO_2$-containing gas mixture.

3. The process of claim 1 wherein (4) said partially cooled overhead stream of skimmed gases from (1) is passed in indirect heat exchange with purified water in at least one additional indirect heat exchange zone.

4. The process of claim 1 provided with the step of cooling the hot raw product stream of mixed gases comprising $H_2$ and CO from (6) by indirect heat exchange with purified water or saturated steam to provide a portion of the superheated steam in (2).

5. The process of claim 1 wherein said solid carbonaceous fuel is a high rank fuel selected from the group consisting of anthracite coal, bituminous coals, coke from coal, char from coal, coal liquefaction residues, particulate carbon, petroleum coke, solids derived from oil shale, tar sands and pitch; and/or low rank fuel selected from the group consisting of sub-bituminous coal, lignite, peat, concentrated sewer sludge, bits of garbage, wood, and mixtures thereof.

6. The process of claim 1 in which said free-oxygen containing gas is selected from the group consisting of air, oxygen-enriched air, i.e., greater than 21 mole % $O_2$, and substantially pure oxygen, i.e. greater than about 95 mole % oxygen.

7. The process of claim 1 in which said temperature moderator is selected from the group consisting of steam, water, $CO_2$-containing gas, nitrogen, recycled synthesis gas, and mixtures thereof.

8. The process of claim 1 wherein (2) said stream of superheated steam is introduced into a pipeline carrying said preheated aqueous slurry stream.

9. The process of claim 1 provided with the steps of monitoring the temperature of the feed mixture of particulate solid carbonaceous fuel and steam to the burner, and cutting off the flow of said overhead stream of skimmed gases from the cyclone separating zone and all of the feed streams to the burner when the temperature of said feed mixture of particulate solid carbonaceous fuel and steam to the burner exceeds a specified value.

10. The process of claim 1 wherein the mole ratio $(H_2O+CO_2)/C$ of the feed entering the reaction zone is in the range of about 0.1 to 3.0.

11. A process for the production of a stream of a mixed gas comprising $H_2$ and CO comprising;

(1) heating an aqueous slurry of low rank particulate solid carbonaceous fuel to a temperature in the range of about 200 to 650° F. in a first indirect heat exchange zone by noncontact heat exchange with a stream of skimmed gases from (3) to produce a preheated aqueous slurry stream and a separate partially cooled stream of skimmed gases;

(2) mixing the preheated aqueous slurry stream from (1) in a mixing zone with a separate stream of superheated steam, thereby vaporizing the water in the slurry and producing a suspension of particulate solid carbonaceous fuel in steam and $CO_2$-containing gas mixture at a temperature of at least 400° F.;

(3) separating from about 10 to 99 wt. % of the gaseous mixture of steam and $CO_2$-containing gas mixture from said suspension from (2) in a gas skimming zone to produce an overhead stream of said skimmed gases, and a bottom stream comprising a mixture of particulate solid carbonaceous fuel with the remainder of said stream and $CO_2$-containing gas mixture;

(4) cooling and condensing $H_2O$ from said partially cooled overhead stream of skimmed gases from (1) by passing said gas stream in indirect heat exchange with a coolant in at least one additional indirect heat exchange zone; and separating a by-product stream of $CO_2$-containing gas mixture from said condensed water in a gas-liquid separating zone; and (5) introducing said bottom stream from the gas skimming zone in (3) by way of a burner into the reaction zone of a free-flow partial oxidation gas generator in admixture with a free-oxygen containing gas and with or without additional temperature moderator, wherein reaction takes place for the production of a hot raw product gas stream comprising $H_2$ and CO.

12. The process of claim 11 where in (2) said particulate solid carbonaceous fuel is entrained in a gaseous mixture substantially comprising 90 and 99.9 wt. % steam, and the remainder comprises a $CO_2$-containing gas mixture.

13. The process of claim 11 provided with a step of purifying the condensed water from (4) to produce a stream of purified water and a separate stream of residual waste water.

14. The process of claim 13 provided with the step of preparing the aqueous slurry in (1) with a portion of said residual waste water.

15. The process of claim 13 provided with the steps of introducing at least a portion of the purified water into the indirect heat exchange zone in (4) as a coolant thereby preheating said water coolant, and then converting the preheated water coolant into at least a portion of the superheated steam for use in (2).

16. The process of claim 11 wherein said low rank solid carbonaceous fuel is selected from the group consisting of sub-bituminous coal, lignite, peat, wood, concentrated sewer sludge, bits of garbage, and mixtures thereof.

17. The process of claim 11 in which said free-oxygen containing gas is selected from the group consisting of air, oxygen-enriched air, i.e., greater than 21 mole % $O_2$, and substantially pure oxygen, i.e. greater than about 95 mole % oxygen.

18. The process of claim 11 in which said temperature moderator is selected from the group consisting of steam, water, $CO_2$-containing gas, nitrogen, and recycled synthesis gas, and mixtures thereof.

19. The process of claim 11 where in (2) said stream of superheated steam is introduced into a pipeline carrying said preheated aqueous slurry stream.

20. The process of claim 11 provided with the steps of cooling the hot raw product stream of mixed gases comprising $H_2$ and CO from (5) by indirect heat exchange with water or saturated steam to produce at least a portion of the superheated steam in (2).

21. The process of claim 11 provided with the step of introducing the particulate solid carbonaceous fuel in (5) into the partial oxidation gas generator while combined with at least a portion of the $CO_2$-containing gas stream from (4).

22. The process of claim 11 provided with the steps of monitoring the temperature of the feed mixture of particulate solid carbonaceous fuel and steam to the burner, and cutting off the flow of said overhead stream of skimmed gases from the skimming zone and all of the feed streams to the burner when the temperature of said feed mixture of particulate solid carbonaceous fuel and steam to the burner exceeds a specified value.

23. The process of claim 13 provided with the steps of preheating said purified water in at least one indirect heat exchange zone in (4) and converting said preheated purified water into superheated steam by indirect heat exchange with the hot raw product stream of mixed gases comprising $H_2$ and CO from (5), and introducing said superheated steam into the preheated aqueous slurry in the mixing zone in (2) as at least a portion of said superheated steam.

24. The process of claim 11 wherein the mole ratio $(H_2O+CO_2)/C$ of the feed entering the reaction zone is in the range of about 0.1 to 3.0.

* * * * *